US009440138B1

(12) United States Patent
Keyes et al.

(10) Patent No.: US 9,440,138 B1
(45) Date of Patent: Sep. 13, 2016

(54) POOL RACK ASSEMBLY

(71) Applicants: P. Andrew Keyes, Miami, FL (US); Steven E. Ruffe, Coral Gables, FL (US)

(72) Inventors: P. Andrew Keyes, Miami, FL (US); Steven E. Ruffe, Coral Gables, FL (US)

( * ) Notice: Subject to any disclaimer, the term of this patent is extended or adjusted under 35 U.S.C. 154(b) by 0 days.

(21) Appl. No.: 14/449,596

(22) Filed: Aug. 1, 2014

(51) Int. Cl.
*A63D 15/00* (2006.01)

(52) U.S. Cl.
CPC ..... *A63D 15/005* (2013.01); *A63D 15/00* (2013.01)

(58) Field of Classification Search
CPC ..... A63D 15/00; A63D 15/005
USPC ..... 473/40, 41, 1, 21, 26
See application file for complete search history.

(56) References Cited

U.S. PATENT DOCUMENTS

| | | | | |
|---|---|---|---|---|
| 702,108 | A | 6/1902 | Marshall | |
| 743,464 | A | 11/1903 | D'Abramo | |
| 952,920 | A | 3/1910 | Meacham | |
| 1,725,494 | A | 8/1929 | Varnum | |
| D240,943 | S | 8/1976 | Kremsi | |
| 3,992,005 | A | 11/1976 | Richey | |
| 4,469,328 | A | 9/1984 | Pacitti | |
| 5,916,032 | A | 6/1999 | Stoll | |
| 6,261,187 | B1 | 7/2001 | Tsai | |
| D480,775 | S * | 10/2003 | Fischer | D21/782 |
| 7,063,620 | B2 * | 6/2006 | Nearhood | A63D 15/005 473/2 |
| 7,166,033 | B2 | 1/2007 | Krajeski | |
| 7,192,358 | B2 | 3/2007 | Knupp | |
| 7,448,954 | B1 | 11/2008 | Reynolds | |
| 7,666,105 | B2 | 2/2010 | Ball et al. | |
| 8,574,089 | B1 * | 11/2013 | Bova | A63D 15/005 473/40 |
| 2014/0256460 | A1 * | 9/2014 | Geiges | A63D 15/005 473/40 |

OTHER PUBLICATIONS

The True Rack Announcement dated May 12, 2010 Ture Rack Website product use and description dated 2012.*

True Rack Billiard Ball Rack, conception announcement dated May 12, 2010; pictures; Quotes vBulletin Solutions, Inc. copyright 2000-2016 DragonByte Technologies Ltd.*

The V Rack.com, http://www.thevrack.com, 6 pages—printed on Sep. 24, 2014.

* cited by examiner

*Primary Examiner* — Mitra Aryanpour
(74) *Attorney, Agent, or Firm* — Malloy & Malloy, P.L.

(57) ABSTRACT

A pool rack assembly for arranging a plurality of pool balls into an operative orientation upon a pool table comprises a containment assembly. The containment assembly includes a first containment member disposed in pivotal relation with a second containment member via a pivoting interconnection. The pool rack assembly is pivoted into a closed disposition to facilitate arrangement of the plurality of pool balls into the operative orientation therein, and pivoted into an open disposition for removing the pool rack assembly from the operatively oriented pool balls. An alignment module may be removably connected to the containment module, and includes at least one light source which projects one or more light indicators. The light indicators are used to align the pool rack assembly, and more importantly, the plurality of operatively oriented pool balls therein, upon a pool table with reference to the rail markers.

19 Claims, 9 Drawing Sheets

POOL RACK ASSEMBLY

BACKGROUND OF THE INVENTION

1. Field of the Invention

The present invention is directed to a pool rack assembly which is utilized in connection with a variety of cue sports including, but not limited to, pool, billiards, and snooker. More specifically, the present invention is directed to an open-ended pool rack, as well as a pool rack which includes an alignment module to facilitate alignment of a rack of balls upon a pool table.

2. Description of the Related Art

In any given game of billiards, it is of primary importance that the balls be racked tightly, i.e., that all balls are abutting and immobile relative to adjacent ones of each other, and that the rack of balls be accurately positioned on the surface of the billiard table. Yet, it is quite difficult to achieve a perfect rack of balls or to place the rack of balls accurately on the table. Some advances have been made in the art that are directed toward solving one or both of these problems.

In the game of pool, a closed triangular frame is commonly provided for arranging the balls. However, because the frame is closed, one must necessarily lift the frame over the rack of balls, which presents the risk of disturbing the rack and necessitating a re-rack of the balls.

One device intended to avoiding such disturbances includes a rigid, V-shaped frame for racking the balls. Once the balls are arranged in the frame and positioned on the table, the frame is pushed forward clear of the balls, thereby minimizing the risk of disturbance.

Another device for minimizing the disturbance of the rack of balls provides a three-part triangle frame with three sides pivoted to the base, together with a latching means at the apex. The latch is operated via a button placed within reach of the base. Furthermore, a setting-up bar is provided to tightly arrange the balls in the rack. The user places the balls into the rack, applies the setting-up bar to snug the balls, and simultaneously depresses the button which operates the latch. Because the rear hinges are spring-actuated, the sides will spread laterally, presenting a clear path from which to remove the frame without disturbing the racked balls. However, the sudden springing open of the sides presents the risk of jostling the racked balls, such that the disturbance of the racked balls may come from the very opening of the latched frame which is designed to prevent disturbance of the balls.

Placing the racked balls accurately on the billiard table presents a separate challenge. Generally, this is done with reference to a spot or a sticker placed onto the felt of the table, denoting where an apex ball is to be placed. However, the presence of any irregularity on the surface of the table, even the thickness of a sticker, is generally discouraged, especially at a professional level of play. Furthermore, the spot does not prevent the rack from being placed askew relative to the side rails of the pool table as is also essential for a proper alignment of the rack of balls on the table. Therefore, devices have been developed to assist in accurately positioning a rack of balls on a pool table.

One such device is a rack having laser apertures at each of its apexes. When positioning the rack of balls on the table, the user must align the lasers with alignment marks placed on the center of the head rail, and on the corner pockets at each corner of the foot rail, respectively. Yet another embodiment relies on a line placed on the table to align the rear cross-member of the rack. Still, a further embodiment includes beam-splitting members placed along the cue line of the table. This device is clumsy and error prone, as it relies on accurate and precise placement of several members onto the pool table itself by the end user. A slight error in the placement of any one of the plurality of members can reduce the accuracy of the system, and errors in placement of multiple members can drastically compound incorrect positioning of the rack of balls on the pool table.

Another device includes a rack with at least one light source, beam splitter, and photo detector. A reflective element must be mounted to the rail of the table. When the rack is properly aligned, the light from the light source on the rack reflects off of the reflective element, travels back toward the beam splitter on the rack, and a portion of the now split beam travels into the photo detector. When the light hits the photo detector, a signal is emitted, such as an audible noise or visual cue. This device is also clumsy and error prone as it once again requires the accurate and precise placement of several members onto the pool table by the end user. As before, any slight error in the placement of one of the auxiliary reflecting surface can reduce the accuracy of the system resulting in incorrect positioning of the rack of balls on the pool table.

Thus, it would be beneficial to provide a billiard rack that can be removed from around a rack of balls without disturbing the rack. Another benefit may be obtained by providing an alignment module which allows a user to precisely position a rack of balls on the surface of a pool table. It would further be beneficial to provide an alignment module which does not require any modification to a standard billiard table for use. Yet another benefit may be realized by combining a billiard rack that can be removed from around a rack of balls without disturbing the rack which includes an alignment module which allows a user to precisely position the rack of balls on the surface of a pool table which does not require any modification to the table itself. The present invention solves these and other needs in the art, as will be disclosed below.

SUMMARY OF THE INVENTION

At least one embodiment of the present invention is directed to a pool rack assembly which can be used to both tightly rack a set of billiard balls in an operative orientation, and accurately and precisely place and align the racked billiard balls on the surface of a billiard table.

The pool rack assembly in one embodiment includes a containment assembly. The containment assembly, in at least one embodiment, includes a first containment member and a second containment member disposed in a pivotal relation to one another at a pivot end, and wherein each of the first and second containment members comprises a side rail, and a free end. This configuration forms a V-shaped pool rack distinct from typical triangular shaped pool racks.

The pivoting, V-shape of a pool rack assembly in accordance with at least one embodiment of the present invention serves a dual purpose. First, it allows the user to gather the pool balls while the assembly is in an open disposition and then easily corral them together by pivoting the containment members together into a closed disposition. Additionally, once the balls are gathered, the curved ends are placed against a back rail of the pool table to allow the user to quickly rack the balls and align the racked balls perpendicular to the rail. Finally, after the pool balls have been tightly racked together, the containment members are simply pivoted away from the racked balls, all but eliminating the risk of disturbing the racked balls by removal of the pool rack assembly.

In one embodiment, a pool rack assembly in accordance with the invention comprises an alignment module which, in at least one further embodiment, is removably disposed on a containment assembly. An alignment module, in one embodiment, includes at least one light source which projects a light indicator therefrom. In one further embodiment, the light source or light sources project a plurality of light indicators which are used to align the pool rack assembly on a pool table. In yet one further embodiment, a pool rack assembly is aligned on a surface of a pool table by aligning one or more light indicators with one or more predetermined points on a pool table, such as, but not limited to, a rail marker.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

Figure 1:
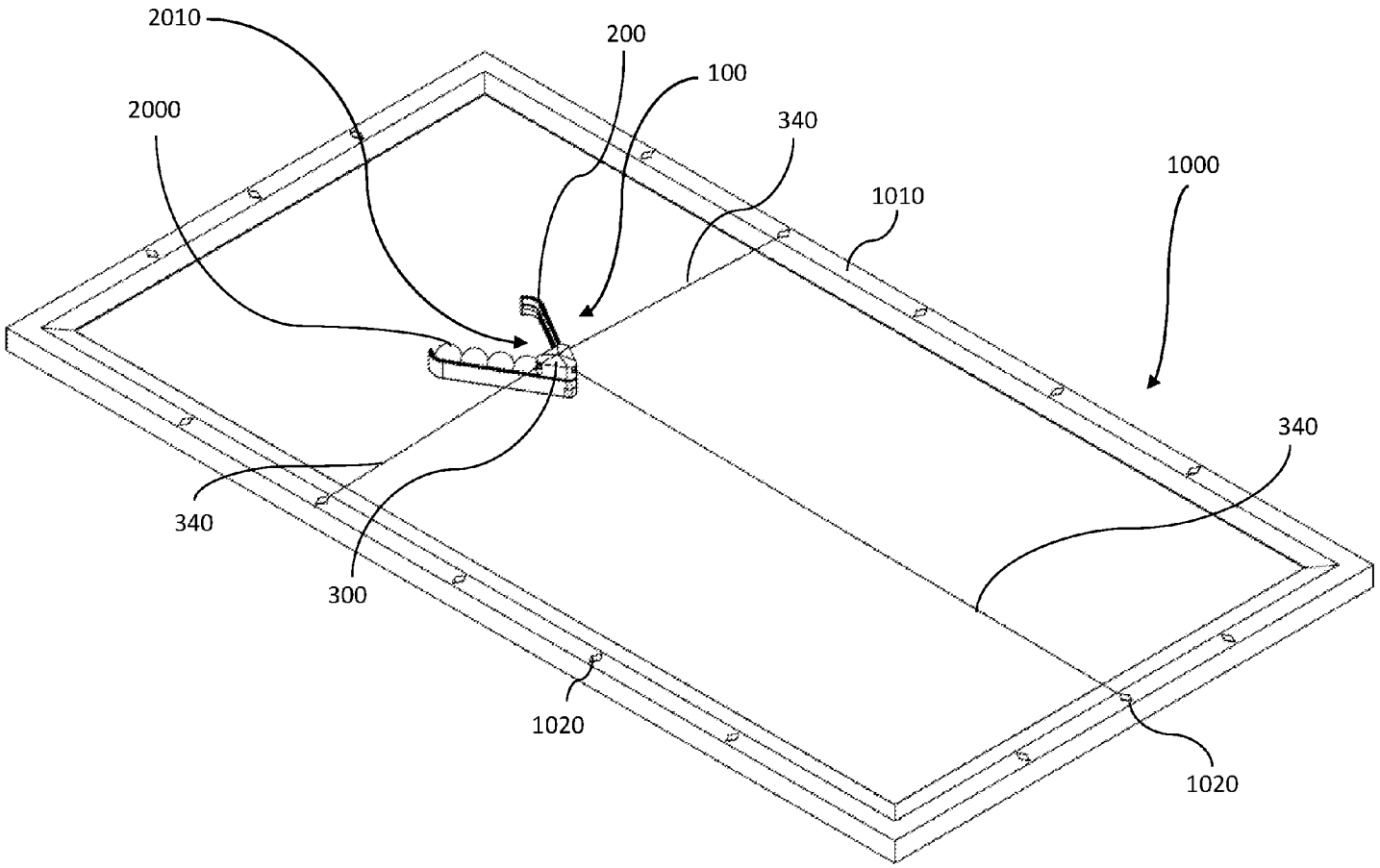
FIG. 1 is a perspective view of one illustrative embodiment of a pool rack assembly in accordance the present invention aligned on a pool table.

With reference to FIG. 1, at least one embodiment of the present invention is directed to a pool rack assembly 100 which can be used to both tightly rack a plurality of pool balls 2000, and accurately and precisely place and align the racked pool balls 2000 on the surface of a pool table 1000. The pool rack assembly 100 as shown in the illustrative embodiment of FIG. 1 includes a containment assembly 200 as well as an alignment assembly 300. A containment assembly 200 in accordance with the present invention, as disclosed in further detail below, facilitates arrangement of a plurality of pool balls 2000 into an operative orientation upon the surface of a pool table 1000. An alignment assembly 300 in accordance with the present invention, also disclosed in further detail below, facilitates alignment of the containment assembly 200, and as such, a plurality of pool balls 2000 operatively oriented therein, with reference to one or more predetermined points on the pool table 1000, such as, for example, one or more rail marker 1020.

Figure 2:
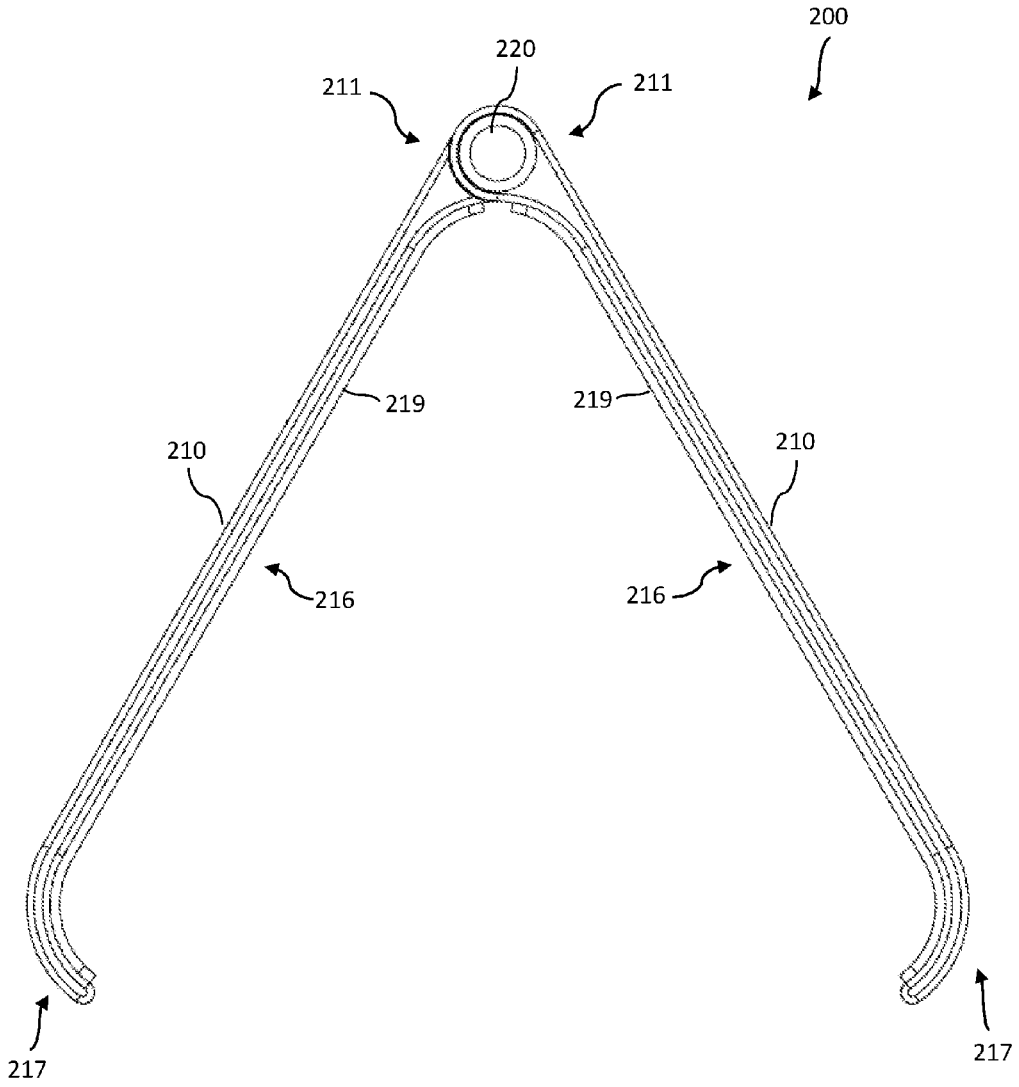
FIG. 2 is a top plan view of another illustrative embodiment of a pool rack assembly in accordance with the present invention in a closed disposition.
Figure 3:
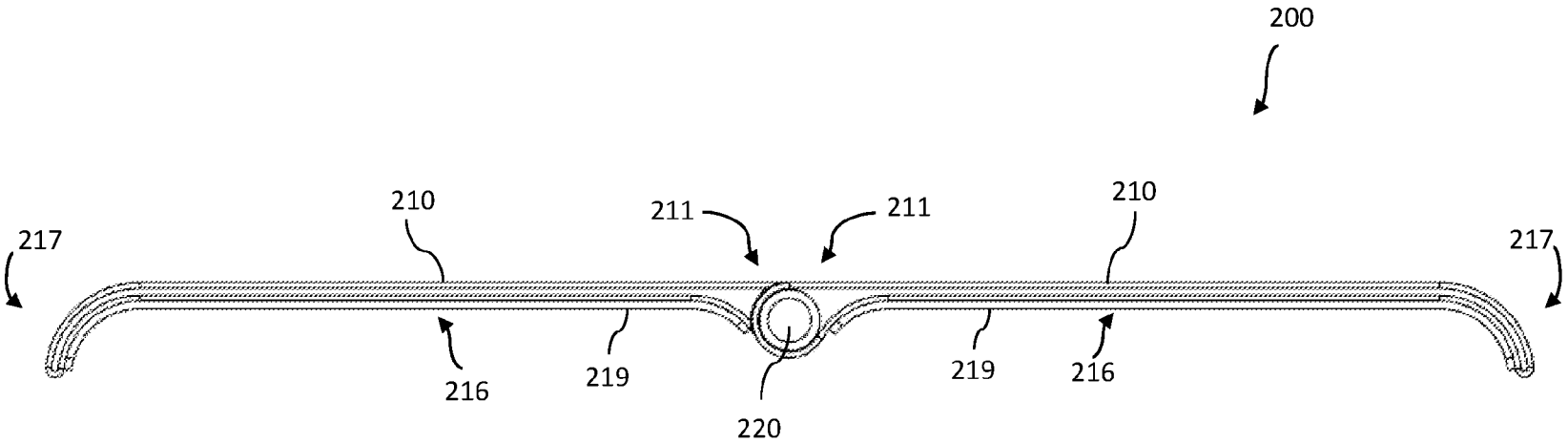
FIG. 3 is a top plan view of the illustrative embodiment of the pool rack assembly of FIG. 2 in an open disposition.

Now with reference to FIGS. 2 and 3, in at least one embodiment, the containment assembly 200 is disposable into a closed disposition, as depicted in FIG. 2, as well as an open disposition, as depicted in FIG. 3, via a pivoting relation of containment members 210. The containment members 210 in at least one embodiment are movably interconnected at a pivot end 211. FIG. 3 further illustrates that each of the containment members 210 includes a pivot end 211, and further, that the pivot ends 211 are configured to abut against one another when the containment assembly 200 is pivoted into an open disposition to prevent the containment members 210 from being positioned at an angle of greater than about 180 degrees relative to one another.

Each of the containment members 210 in accordance with one embodiment of the present invention includes a side rail 216 and a free end 217. The side rail 216 of each containment member 210 facilitates the arrangement of the pool balls 200 into an operative orientation, for example, a triangular or diamond shaped orientation in preparation for the first shot in a game of pool. Thus it will be appreciated that the side rail 216 in at least one embodiment is formed of a substantially rigid material, such as a hard plastic or metal, so as to retain its shape when pressed against a plurality of pool balls 2000.

The free end 217 of each containment member 210 facilitates the removal of the pool rack assembly 100 from around the plurality of pool balls 2000 once they have been positioned in an operative orientation on the pool table, without disturbing the tracked balls. More in particular, the open-ended character of the free ends 217 of two pivotally disposed containment members 210 allows the containment assembly 200 to be disposed into an open disposition without contacting or otherwise disturbing any of the operatively oriented balls. In at least one embodiment, the free end 217 includes an arcuate portion to facilitate containment of the plurality of pool balls 2000 within the containment members 210 of the containment assembly 200.

In at least one embodiment, each of the containment members 210 includes a resilient member 219 disposed on an inner surface of the side rail 216. In one further embodiment, a resilient member 219 is disposed along the inner surface of the side rail 216 from the pivot end 211 to free end 217. The resilient member 219 is formed of a material which compresses upon contact with the outermost pool balls 2000 and conforms to minor imperfections or irregularities in one or more of the outermost pool balls 2000 in the rack. As just one example, minor variations in the diameter of adjacent pool balls 2000 could result in less than a perfect rack of the pool balls 2000 when forced into position by the rigid members of a standard pool rack. The resilient members 219 in accordance with at least one embodiment of the present invention are formed from any of a number of materials including, but not limited to foam, rubber, neoprene, latex, etc.

Figure 4:
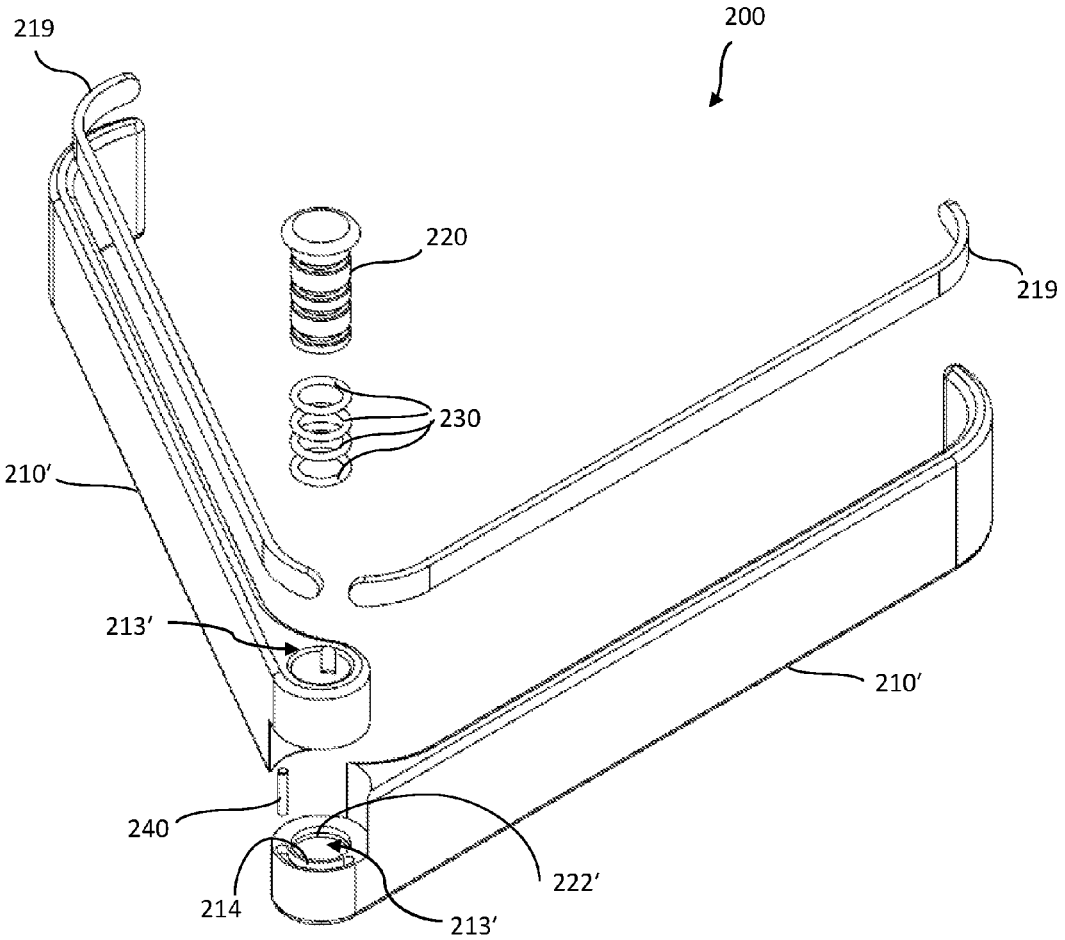
FIG. 4 is an exploded perspective view of the illustrative embodiment of the pool rack assembly of FIG. 2 in accordance with the present invention.
Figure 5:
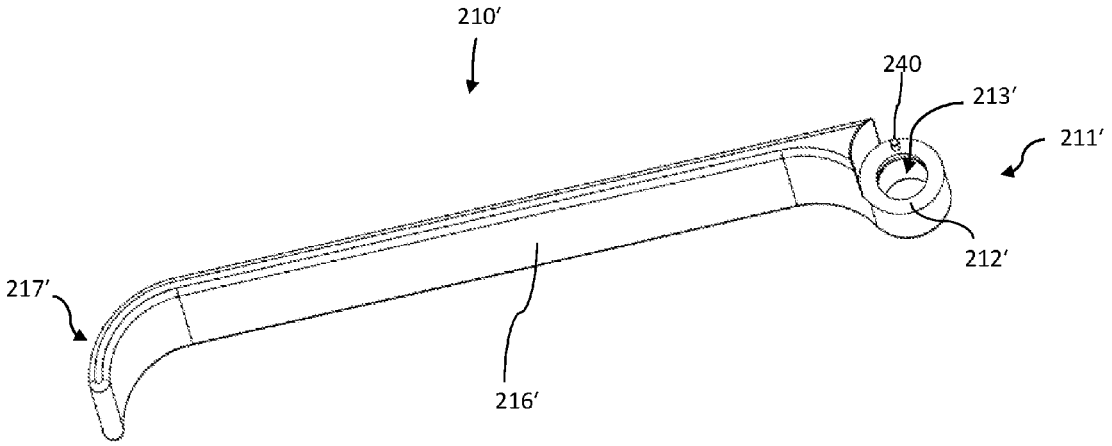
FIG. 5 is a perspective view of a first containment member of the illustrative embodiment of the pool rack assembly of FIG. 2.
Figure 6:
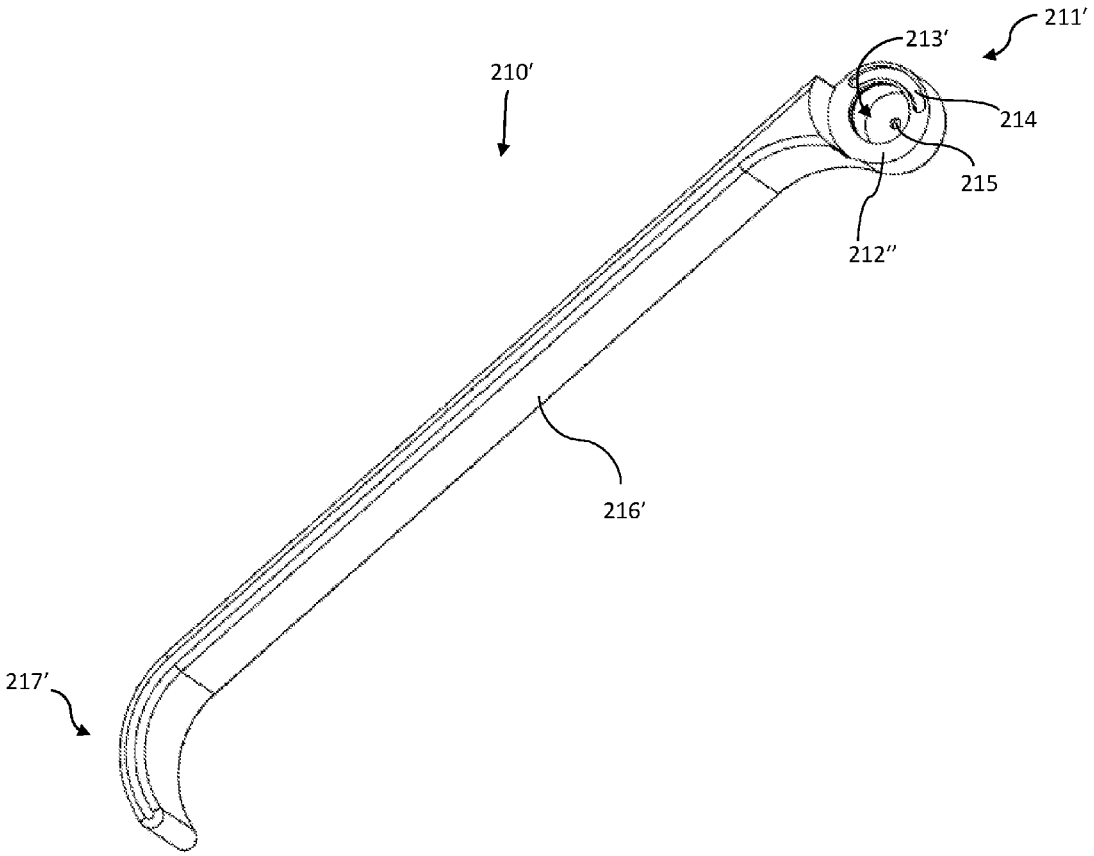
FIG. 6 is a perspective view a second containment member of the illustrative embodiment of the pool rack assembly of FIG. 2.
Figure 8:
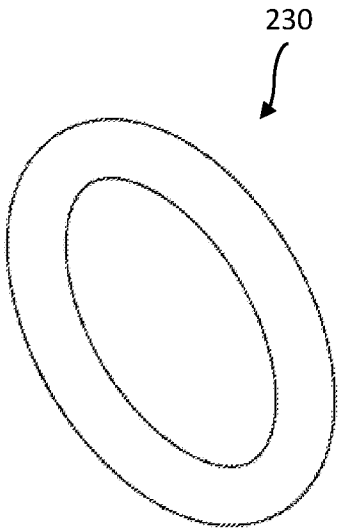
FIG. 8 is a perspective view of one illustrative embodiment of a retention member in accordance with the present invention.

It will be appreciated that each of the containment members 210 of a containment assembly 200 in accordance with at least one embodiment of the present invention comprises substantially identical components. In other embodiments, such as the illustrative embodiments as shown in FIGS. 4, 5, and 6, a containment assembly 200 comprises a first containment member 210' and a second containment member 210" including variations unique to each. It will also be appreciated that the terms "first containment member" and "second containment member" are merely naming conventions, and it is not necessary to the operation of the invention that the first containment member 210' includes specific features or that the second containment member 210" includes specific features, as long as the features of both are cooperatively disposed to achieve the operation of the invention. Accordingly, either containment member 210 may contain reciprocal structure such as a first pivot end 211' disposed on the first containment member 210' and a second pivot end 211" disposed on the second containment member 210", etc.

In at least one embodiment, and as disclosed above, a containment assembly 200 comprises a first containment member 210' and a second containment member 210". As depicted in the illustrative embodiment of FIG. 5, the first containment member 210' includes a first pivot aperture 213' comprising a channel or hole through a first mating interface 212' on the first pivot end 211'. The first mating interface 212', in at least one embodiment, includes a guide member 240 projecting therefrom, and in one further embodiment, the guide member 240 is formed of a pin or dowel inserted into a guide member aperture (not shown) on the first mating interface 212'. Of course, it is within the scope and intent of the present invention for a guide member 240 to be integrally and/or unitarily formed with a first mating interface 212' of a first containment member 210'.

As depicted in the illustrative embodiment of FIG. 6, a second containment member 210" includes a second pivot aperture 213" which is substantially formed of a channel or hole formed at least partially into a second mating interface 212". In at least one embodiment, the second pivot aperture 213" comprises a closed end, and in one further embodiment, a vacuum break 215, such as, but not limited to a relatively small hole, is formed through the closed end of the second pivot aperture 213". The vacuum break serves to prevent forming a vacuum in the second pivot aperture 213" while removing a pivot member 220 therefrom. More in particular, the vacuum break allows air to enter the second pivot aperture 213" to displace the volume occupied by a pivot member 220 as the pivot member 220 is removed from the second pivot aperture 213". The second mating interface 212", in at least one embodiment, further include a guide channel 214 formed therein, wherein the guide channel 214 is cooperatively dimensioned to receive a guide member 240 therein.

As depicted in the illustrative embodiment of FIG. 4, disposition of a first containment member 210' in a pivoting relation with a second containment member 210" is at least partially defined by a first pivot aperture 213' aligned with a second pivot aperture 213". In one further embodiment, a pivot member 220 is disposed through a first pivot aperture 213' and at least partially into a second pivot aperture 213", thereby movably and pivotally interconnecting a first containment member 210' in pivotal relation to a second containment member 210".

As will be further appreciated from FIG. 4, a guide member 240 is disposable into a guide channel 214 when the first containment member 210' is disposed in a pivotal relation with the second containment member 210". Further, the guide member 240 is movable within the guide channel 214 upon movement of the first containment member 210' relative to the second containment member 210". In at least one embodiment, a guide member 240 travels in and along a guide channel 214 until the guide member 240 reaches one of the ends of the guide channel 214, thus, the oppositely disposed ends of the guide channel 214 define in part the limits to which the containment assembly 200 may be disposed in an open disposition or a closed disposition, for example, as depicted in FIGS. 2 and 3. Stated otherwise, the arc length of a guide channel 214 at least partially defines the angular range of travel of the containment members 210 of a containment assembly 200 between an open disposition and closed disposition. In at least one embodiment, the maximum angle allowed between the containment members 210 while in an open disposition is 180 degrees as a result of opposing pivot ends 211 abutting against one another, as shown best in FIG. 3.

Figure 7:
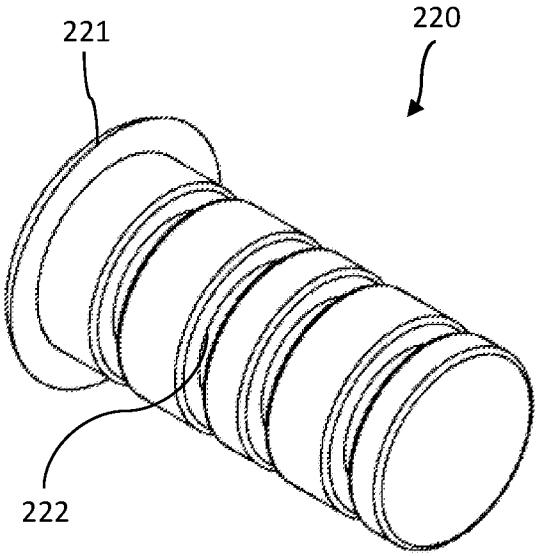
FIG. 7 is a perspective view of one illustrative embodiment of a pivot member in accordance with the present invention.

The illustrative embodiment of FIG. 7 depicts one embodiment of a pivot member 220, such as is shown in FIG. 4. In at least one embodiment, the pivot member 220 comprises a substantially cylindrical body, cooperatively dimensioned to be inserted into or through one or more pivot apertures 213. The pivot member 220, as shown in FIG. 7, includes a cap 221 to facilitate retention and/or removal of the pivot member 220 from one or more pivot apertures 213 (not shown). In at least one embodiment, the cap 221 includes an enlarged and relatively flat portion, and in one further embodiment, the cap 221 is unitary with and extends radially outward from one end of the pivot member 220. In one other embodiment, the pivot member 220 includes one or more retention channels 222 recessed therein. A retention member 230, in at least one embodiment, is disposed in a corresponding retention channel 222 of the pivot member 220. In at least one embodiment, a pivot member 220 comprises a plurality of retention channels 222, and each of a corresponding plurality of retention members 230 is operatively disposed in each retention channel 222. In at least one embodiment, a retention member 230 comprises an O-ring, and in one further embodiment, the retention member 230 is constructed of a resilient material including but not limited to rubber, plastic, latex, etc.

Returning now to the illustrative embodiment of FIG. 4, the pivot member 220 and plurality of retention members 230 are correspondingly disposed to facilitate the releasably secure retention of the pivot member 220 within one or more pivot apertures 213. More in particular, in at least one embodiment, a first pivot aperture 213' and/or a second pivot aperture 213" include one or more retention channel 222' formed therein which are correspondingly disposed with one or more retention member 230 mounted to a pivot member 220. As will be appreciated by those of skill in the art, the retention channels 222' further facilitate releasably secure retention of a pivot member 220 within pivot aperture(s) 213 by way of operative engagement of one or more retention member 230 within a corresponding one or more retention channel 222'.

Figure 9:
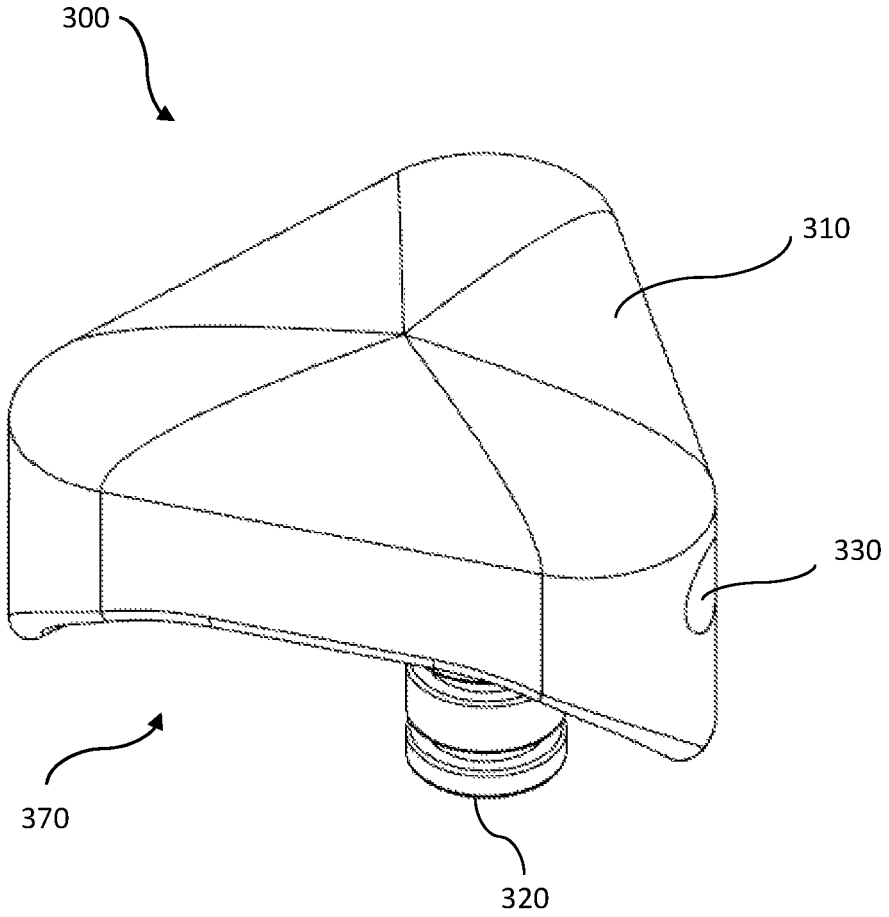
FIG. 9 is a perspective view of one illustrative embodiment of an alignment module in accordance with the present invention.

Turning next to the illustrative embodiment of FIG. 9, one embodiment of an alignment module 300 is depicted which includes a housing 310. The alignment module 300 includes at least one light source 330 mounted to housing 310 which projects one or more light indicator 340, such as, by way of example, a laser beam. In one embodiment, the light source 330 of an alignment module 300 projects a single light indicator 340, for example, a single light indicator 340 directed towards a rail 1010 opposite the pool rack assembly 100. In at least one further embodiment, a light source 330 of an alignment module 300 projects a plurality of light indicators 340, such as is shown by way of example in FIG. 1. As may be seen from the illustrative embodiment of FIG.

1, each of the plurality of light indicators 340 is projected towards a different rail 1010 of the pool table 1000, and furthermore, each light indicator 340 is projected towards a rail marker 1020 on each of the different rails 1010.

Typically, rail markers 1020 are installed at the time of manufacture of a pool table 1000 and are provided to allow a user to align and position a rack of pool balls 2000 on the pool table 1000 to the best of the user's ability. Of course, such alignment and positioning is limited by each user's ability to visualize a straight line between the rack of pool balls 2000 and one or more rail markers 1020. However, the plurality of light indicators 340 significantly increases the ability of any user to visually align and position a pool rack assembly 100 with a plurality of rail markers 1020 on each of the different rails 1010, such that the pool rack assembly 100 is precisely and accurately positioned on the surface of the pool table 1000, and, more importantly, the plurality of pool balls 2000 which are operatively oriented into a racked configuration are precisely and accurately positioned on the surface of the pool table 1000 for the first shot in a game of pool.

In at least one embodiment, the alignment module 300 includes a pivot member 320 mounted to a portion of a housing 310. In at least one embodiment of a rack assembly 100 in accordance with the present invention, a pivot member 320 of an alignment module 300 is structured and dimensioned substantially similar to pivot member 220 as disclosed and described above with reference to FIGS. 4 and 7, thus permitting use of the pool rack assembly 100 with or without the alignment module 300.

In yet one further embodiment, an alignment module 300 includes a clearance 370 comprising a recessed or curved portion of the housing 310 to allow at least a portion of the alignment module 300 to be disposed over one of the plurality of pool balls 2000. More in particular, in at least one embodiment, at least a portion of the alignment module 300 is disposed over an apex ball 2010 disposed in a forwardmost position of the operative orientation of pool balls 2000, as depicted in FIG. 1. Furthermore, as evident from the depiction in FIG. 1, this disposition allows a plurality of light indicators 340 to originate centrally over an apex ball 2010 thus facilitating alignment of the containment assembly 200, and as such, the plurality of pool balls 2000 operatively oriented therein, with reference to one or more predetermined points on the pool table 1000, such as, once again, one or more rail marker 1020.

Figure 10:
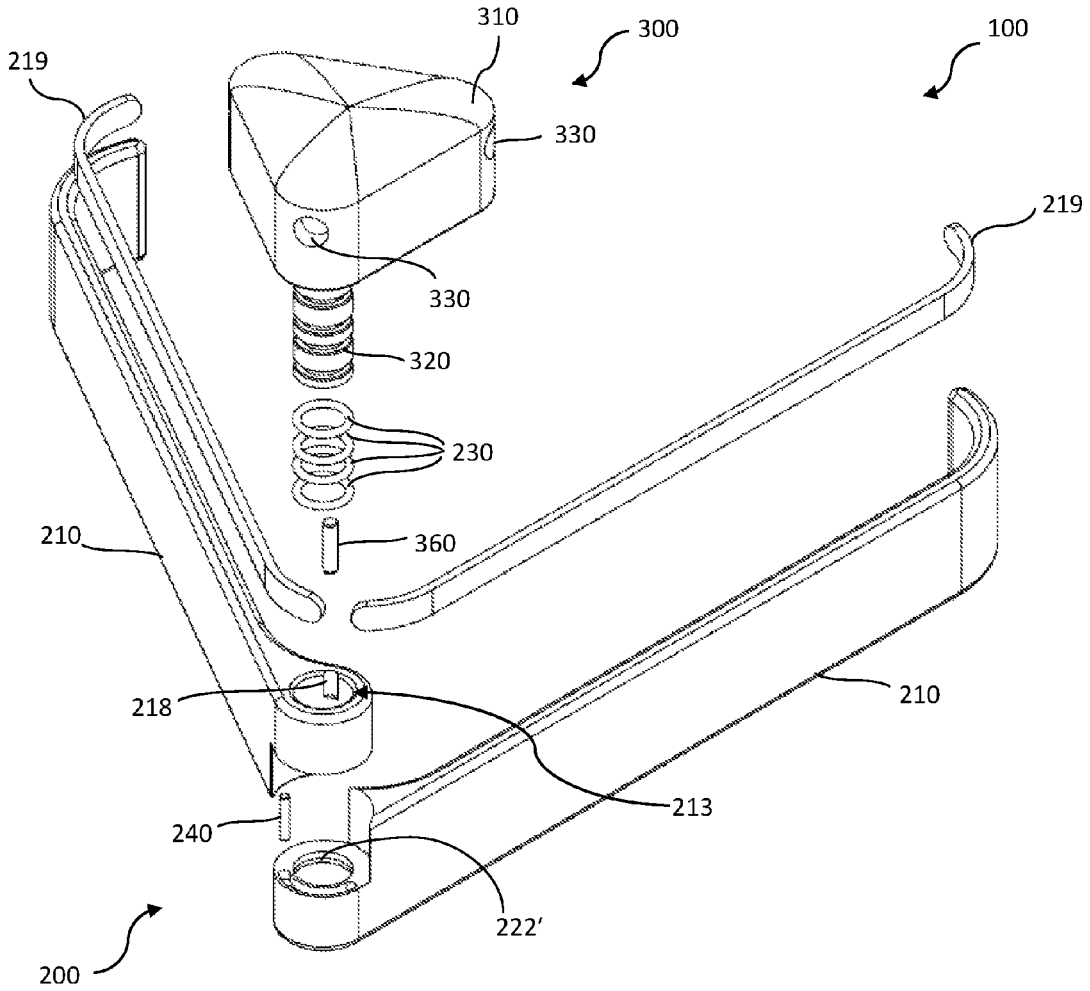
FIG. 10 is an exploded perspective view of another illustrative embodiment of a pool rack assembly in accordance with the present invention including an alignment module.

In one embodiment, a rack assembly 100 in accordance with the present invention includes an alignment module key 360 and a corresponding alignment module keyway 218 cooperatively structured and disposed to maintain the alignment module 300 in a true alignment relative to containment assembly 200. More in particular, in at least one embodiment, an alignment module key 360 is mounted to a housing 310 of an alignment module 300, and a corresponding alignment module keyway 218 is formed in a portion of a containment member 210 and is structured and dimensioned to receive at least a portion of an alignment module key 360 therein. With reference to the illustrative embodiment of FIG. 10, an alignment module keyway 218 is formed in a pivot aperture 213 of containment member 210 and is positioned to receive at least a portion of alignment module key 360 therein, thereby preventing movement of the alignment module 300 relative to the containment assembly 200, and assuring true alignment therebetween.

Since many modifications, variations and changes in detail can be made to the described embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A pool rack assembly for arranging a plurality of pool balls into an operative orientation upon a pool table comprising:

a containment assembly comprising a first containment member and a second containment member, said first containment member including at least a first pivot end, a first side rail, and a first free end;

said second containment member including at least a second pivot end, a second side rail, and a second free end;

said first pivot end including at least a first mating interface, wherein said first mating interface further includes a guide member projecting therefrom;

said second pivot end including at least a second mating interface;

said first containment member and said second containment member disposed in a pivoting relation to one another wherein said pivoting relation is at least partially defined by said first pivot end and said second pivot end movably interconnected to one another, and said first containment member and said second containment member are positionable between a closed disposition which is at least partially defined by said first side rail and said second side rail forming a closed angle of about sixty degrees therebetween and an open disposition which is at least partially defined by said first side rail and said second side rail forming an open angle of about one-hundred and eighty degrees therebetween.

2. The pool rack assembly as recited in claim 1 wherein said first mating interface comprises a first pivot aperture.

3. The pool rack assembly as recited in claim 2 wherein said second mating interface comprises a second pivot aperture.

4. The pool rack assembly as recited in claim 3 wherein a pivot member is at least partially disposable into said first pivot aperture.

5. The pool rack assembly as recited in claim 4 wherein said pivot member is at least partially disposable into said second pivot aperture.

6. The pool rack assembly as recited in claim 5 wherein said first containment member and said second containment member are disposable in a pivoting interconnection, said pivoting interconnection at least partially defined by said pivot member concurrently disposed at least partially into said first pivot aperture and at least partially into said second pivot aperture.

7. The pool rack assembly as recited in claim 1 wherein said first side rail is substantially rigid in construction.

8. The pool rack assembly as recited in claim 7 wherein said first side rail further includes at least one resilient member disposed thereon in a yielding relation between said first side rail and at least one of the plurality of pool balls.

9. The pool rack assembly as recited in claim 1 wherein said second side rail is substantially rigid in construction.

10. The pool rack assembly as recited in claim 9 wherein said second side rail further includes at least one resilient member disposed thereon in a yielding relation between said second side rail and at least one of the plurality of pool balls.

11. The pool rack assembly as recited in claim 1 wherein said second mating interface further includes a guide channel recessed therein.

12. The pool rack assembly as recited in claim 11 wherein said guide member is movably disposable within said guide channel when said first containment member and said second containment member are disposed in said pivoting relation to one another.

13. The pool rack assembly as recited in claim 12 wherein said guide member travels within said guide channel when said first containment member is pivoted relative to said second containment member.

14. A pool rack assembly for arranging a plurality of pool balls including an apex ball disposed at a forwardmost position into an operative orientation upon a pool table with reference to at least one predetermined point on the pool table, said assembly comprising:

a containment assembly consisting of a pair of containment members pivotally interconnected and cooperatively disposed to operatively orient the plurality of pool balls on the pool table;

an alignment module removably interconnected to said containment assembly via an alignment module key cooperatively structured and disposed relative to a corresponding alignment module keyway formed on a portion of said containment assembly to maintain said alignment module in a true alignment relative to said containment assembly; and said alignment module comprising at least one light source which projects at least one light indicator to the at least one predetermined point on the pool table to facilitate positioning the plurality of pool balls on the pool table with respect to the at least one predetermined point on the pool table.

15. The pool rack assembly as recited in claim 14 wherein at least a portion of said alignment module is disposed in overlying relation to the apex ball while disposed in said operative orientation in said containment assembly so that said at least one light indicator originates centrally over the apex ball thereby facilitating alignment of the plurality of pool balls operatively oriented in said containment assembly with reference to the at least one predetermined point on the pool table.

16. A pool rack assembly for arranging a plurality of pool balls into an operative orientation upon a pool table wherein the pool table includes a pair of end rails, a corresponding pair of side rails, and a plurality of rail markers disposed thereupon, and the plurality of pool balls includes an apex ball disposed at a forwardmost position of the operative orientation of pool balls, said assembly comprising:

a containment assembly comprising a first containment member and a second containment member;

said first containment member including a first pivot end including a first pivot aperture;

said second containment member including a second pivot end including a second pivot aperture;

said first containment member and said second containment member are positionable between a closed disposition which is at least partially defined by a closed angle of about sixty degrees therebetween and an open disposition which is at least partially defined by an open angle of about one-hundred and eighty degrees therebetween;

a pivot member having oppositely disposed ends, one of said oppositely disposed ends disposed through said first pivot aperture;

said one of said oppositely disposed ends of said pivot member further disposed at least partially into said second pivot aperture;

an alignment module mounted in overlying relation relative to said containment assembly via an alignment module key cooperatively structured and disposed relative to a corresponding alignment module keyway formed on a portion of said containment assembly to maintain said alignment module in a true alignment relative to said containment assembly; and said alignment module including at least one light source which projects a plurality of light indicators to different ones of the plurality of rail markers to facilitate positioning the plurality of pool balls on the pool table with respect to one or more of the plurality of rail markers on the pool table.

17. The pool rack assembly as recited in claim 16 wherein said alignment module is at least partially disposed in an overlying relation to the apex ball to facilitate alignment of the plurality of pool balls operatively oriented in said containment assembly with respect to one or more of the plurality of rail markers on the pool table.

18. The pool rack assembly as recited in claim 17 wherein said plurality of light indicators are disposed in a centrally originating relation over the apex ball.

19. The pool rack assembly as recited in claim 18 wherein the plurality of rail markers include at least one rail marker disposed on an end rail and a pair of rail markers oppositely disposed from one another on each of the corresponding side rails.

* * * * *